US006585130B2

(12) United States Patent
Turbett et al.

(10) Patent No.: US 6,585,130 B2
(45) Date of Patent: Jul. 1, 2003

(54) WIPE DISPENSER

(75) Inventors: James Lynn Turbett, Darien, CT (US); Natalie Charambura, Fairfield, CT (US); Michael Edward Ross, Oxford, CT (US)

(73) Assignee: Unilever Home & Personal Care, USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/909,159

(22) Filed: Jul. 19, 2001

(65) Prior Publication Data

US 2003/0015543 A1 Jan. 23, 2003

(51) Int. Cl.[7] ..... B65H 1/00

(52) U.S. Cl. ..... 221/45; 221/46; 221/61; 221/63

(58) Field of Search ..... 221/33, 45, 46, 221/61, 63, 283, 197, 287

(56) References Cited

U.S. PATENT DOCUMENTS

| | | | | |
|---|---|---|---|---|
| 2,382,368 A | * | 8/1945 | Mitchell, Jr. | |
| 2,854,134 A | * | 9/1958 | Humphrey | |
| 2,902,187 A | * | 9/1959 | Cabanban | |
| 2,976,096 A | | 3/1961 | Rueckert | |
| 4,175,673 A | * | 11/1979 | McDonald et al. | 221/63 |
| 4,462,507 A | * | 7/1984 | Margulies | 221/63 |
| D276,960 S | | 1/1985 | Dunn | |
| 4,553,275 A | | 11/1985 | Goldstein | |
| 4,706,845 A | | 11/1987 | Schnurer | |
| 4,728,006 A | | 3/1988 | Drobish et al. | |
| 4,765,482 A | | 8/1988 | Delia | |
| 4,915,257 A | | 4/1990 | Bailey | |
| 5,076,424 A | | 12/1991 | Nakamura | |
| 5,135,134 A | * | 8/1992 | Dancy | 221/63 X |
| 5,273,184 A | | 12/1993 | Rizzuto | |
| 5,715,971 A | * | 2/1998 | Morand | 221/45 |
| 5,803,373 A | | 9/1998 | Sedlock, Jr. et al. | |
| 6,010,031 A | * | 1/2000 | Fox | |
| 6,209,724 B1 | | 4/2001 | Miller | |

FOREIGN PATENT DOCUMENTS

| | | |
|---|---|---|
| CA | 2269379 | 10/2000 |
| DE | 297 15548 | 12/1997 |
| EP | 1 078 594 A1 | 2/2001 |
| JP | 9 154765 | 6/1997 |
| JP | 10 236549 | 9/1998 |
| WO | 93/17933 | 9/1993 |
| WO | 96/06556 | 7/1996 |
| WO | 97/43938 | 11/1997 |
| WO | 98/22009 | 5/1998 |
| WO | 98/40002 | 9/1998 |
| WO | 99/33384 | 8/1999 |
| WO | 99/06311 | 11/1999 |
| WO | 00/33713 | 6/2000 |

OTHER PUBLICATIONS

PCT International Search Report PCT/EP 02/07155 mailed Feb. 10, 2002, 3 pp.

Derwent Abstract of JP 9154765—WPI acct. 1997–367240/199734—1 p.

Derwent Abstract of JP 10236549—WPI acct. 1998–537025/199846—1 p.

* cited by examiner

*Primary Examiner*—David H. Bollinger
(74) *Attorney, Agent, or Firm*—Alan A. Bornstein

(57) ABSTRACT

A dispenser for the wipes is described suitable for use in a shower environment, utilizing a shell having opposed top and bottom ends and, in a preferred embodiment, a support device connected to the shell for securing the dispenser to an outside surface. In another embodiment, the dispenser prevents water spray from the shower from contaminating the wipes contained therein. The bottom end has a dispensing slot with a length dimension greater than a width dimension and a finger-access opening to enable the user to urge wipes in the direction of the dispensing slot. The inventive wipe dispenser also is conveniently refilled with disposable wipes.

31 Claims, 14 Drawing Sheets

WIPE DISPENSER

BACKGROUND OF THE INVENTION

1. Field of the Invention

The present invention relates generally to wipe dispensers and more particularly to wipe dispensers for a stack of wipes.

2. The Related Art

Disposable cleansing wipes are in widespread use for a variety of cleansing operations. Typically, these disposable wipes are individually folded and wrapped in flexible or rigid plastic or in metal foil-type packages. These wipe dispensers suffer from the disadvantage that the user must open a lid or flap to retrieve an individual wipe and in so doing, risk contaminating the other wipes or taking out more than one wipe at a time. This is inconvenient and can potentially contaminate the entire stack of disposable wipes in the dispenser.

More recently it has been found that disposable cleansing wipes can serve as a disposable cleansing implement for personal hygiene in, for example, a shower or bath. In this instance it would be desirable to have a dispenser for disposable wipes that can be used in the shower or bath, that was not subject to contamination from the shower or by the user, was convenient to use, and facilitated dispensing one wipe at a time. It would also be desirable for the wipe dispensing system for the shower or bath to keep the wipes dry and allow easy dispensing and refilling. Furthermore, it would also be desirable to have the cleansing wipe dispenser appropriately secured to the outside surface in the shower, such as a shower curtain rod or wall fixture so as to be convenient to use. Preferably wipes that are sufficiently stiff and flexible when wet for body washing application are used. More preferably these wipes are substantially dry before use.

U.S. Pat. No. 4,553,275 issued to J. Goldstein on Nov. 19, 1985 discloses a dispenser for soap-impregnated wash cloths adapted for mounting on a shower or bathroom wall. This dispenser is disadvantageous in that it may allow shower spray to contact and contaminate the wash cloths stored therein.

PCT publication WO 00/33713 to J. Spencer et al., published on Jun. 15, 2000 discloses a container and cartridge for dispensing controlled amounts of paper products. This dispenser is disadvantageous for use in a shower environment because the slot is exposed to shower spray, and the towels that are arranged adjacent to the slot may become contaminated with water from the shower.

EP Patent Application No. 1078594 to I. Fischer, published on Sep. 14, 2000, discloses a flat article dispensing device which is designed to dispense paper or more moist towels and the like. This dispenser is likewise disadvantageous because the towels are dispensed through a side slot which is exposed to contamination from shower spray. Fisher's device is also cumbersome to use because a panel must be depressed in order to cause a towel to be ejected from the side slot.

There is thus a need for a stacking-type, substantially dry cleansing wipe dispenser containing a plurality of wipes that are readily separable from the stack and are dispensed one at a time from a dispenser. The dispenser should be sealed from contamination from both the user and from the shower and both provide a way of securing the dispenser to the shower area and a sealing mechanism for preventing contamination of the wipes. It would be additionally desirable for the dispenser to accept a replacement refill conveniently.

SUMMARY OF THE INVENTION

In one aspect of this invention, a dispenser for wipes is provided comprising:

a. a shell having opposed first and second ends;

b. a support device connected to the shell for securing the dispenser to an outside surface; the second end defined by a bottom surface having a dispensing slot with a length dimension greater than a width dimension, and c. a finger access opening located at an effective distance from the dispensing slot for urging at least one of the wipes in the direction of the dispensing slot.

Preferably the dispenser for wipes further comprises a lid coupled to the second end for movement between a closed position covering the dispensing slot and an open position exposing the dispensing slot. Advantageously the second end is removably attached to the shell to aid in replenishing the wipes stored in the shell. Any suitable support device for the wipes dispenser may be used. Advantageously, the support device of the wipes dispenser is selected from mechanical couplers, such as clamps, hooks, snaps, latching tabs, corresponding hook and loop structures (e.g. Velcro ®), tongue and groove elements; a ring or a rope; a magnetic coupler, a suction coupler; and an adhesive and the like. Preferably the support device for the dispenser is a hook having a base which is pivotally coupled to the shell for movement between a retracted storage position and an extended position for engaging an outer surface. Advantageously the shell has a recessed portion and a protuberance rigidly connected to the shell, such that the hook in its retracted storage position is arranged in the recessed portion of the shell and in pressing engagement with the protuberance in order to provide a sleek appearance for the dispenser.

Preferably, the wipes dispenser's finger access opening intersects with the dispensing slot to facilitate moving the next wipe in the stack to the dispensing slot for dispensing.

Preferably the wipe dispenser has its shell closed at the first end of the shell. This aids in preventing shower water spray from contaminating the wipes contained in the shell.

In another aspect of the invention a dispenser system for dispensing disposable wipes is provided, comprising:

a. a shell having opposed first and second ends;

b. a support device connected to the shell for securing the shell to an outside surface;

c. the second end defined by a bottom surface having a dispensing slot with a length dimension greater than a width dimension, and a finger access opening located at an effective distance from the dispensing slot for urging the wipes in the direction of the dispensing slot; and d. a plurality of individual disposable wipes, each having a leading edge, positioned within the shell, and stacked with the leading edge of each of the plurality of wipes is supported by the bottom surface.

Individual wipes are here defined as wipes that are stacked together but are not otherwise attached to each other. Preferably, the plurality of wipes is inside a refill dispenser positioned within the shell. Preferably the inventive dispenser system has a lid pivotably coupled to the openable bottom surface for movement between a closed position and an open position for dispensing wipes. Advantageously the refill dispenser is a thermoplastic, flexible pouch having a line of weakness facilitating user access to the wipes contained in the pouch.

In another aspect of the invention, the inventive dispenser system employs disposable wipes that are substantially dry and contain at least one lathering surfactant. Substantial dryness is here defined as the moisture content of the wipe and cleansing composition combination being less than 15% by weight. Preferably at least one lathering surfactant is an anionic surfactant. Advantageously the anionic surfactant is present in the concentration range of about 20 to about 80 wt. % based on the wipe.

Preferably the refill has a plurality of wipes with sufficient compressible thickness to dispenser slot width ratio to allow removal of each of the plurality of wipes, one at a time, through a dispensing slot when the leading edge of each of the plurality of wipes is sequentially aligned with the dispensing slot. Most preferably, the wipes' uncompressed thickness to dispenser slot width ratio is in the range of about 2:1 to about 1:4.

The inventive dispenser system preferably contains wipes that are separately folded and are not interfolded, bonded to, or connected with adjacent wipes. Most preferably, the length of the leading edge of the wipes may be reduced by half if the wipe is c-folded, and reduced by two-thirds if the wipe is z-folded in order to provide a more compact dispenser and refill.

In another aspect of the present invention a method for dispensing wipes is provided, comprising the steps of:

a. inserting a stack of a plurality of individual wipes in to a shell;

b. positioning a plurality of leading edges of the stack of wipes adjacent to a surface wherein the surface defines a dispensing slot having a length dimension greater than a width dimension, and a finger access opening located at an effective distance from the dispensing slot for urging the wipes in the direction of the dispensing slot;

c. urging at least one of the plurality of wipes to the dispensing slot by contacting the leading edge of the at least one of the plurality of wipes through the finger access opening and pushing the wipes to the dispensing slot;

d. flexing the leading edge of at least one of the plurality of wipes so that the edge is aligned with the dispensing slot, and e. pulling the at least one wipe through the dispensing slot.

Preferably the surface adjacent to the wipe's leading edge is a bottom surface which supports the stack of wipes. Advantageously a support device is connected to the shell for securing the shell to an outside surface. Preferably the surface defined finger access opening intersects with the dispensing slot.

In another aspect of the invention, a dispenser for containing wipes usable in a shower environment is provided, comprising:

a) a shell having opposed top and bottom ends, an outer surface connecting the top and bottom ends, and an opening defined by a rim at the bottom end through which wiping articles may be dispensed;

b) a cap fittable over the rim; and c) a gutter adjacent to the lid for collecting water impinging on the outer surface and directing the water away from the wipes contained within the shell.

Preferably the inventive dispenser has a surface adjacent to the gutter arranged for sealingly contacting the rim when the cap is fitted over the rim. More preferably the surface is disposed within the gutter and the gutter is formed within the cap.

Advantageously, the cap defines a dispensing slot having a length dimension greater than a width dimension and a finger access opening located at an effective distance from the dispensing slot for urging at least one of the wipes in the direction of the dispensing opening.

Preferably the gutter defines at least one drainage hole for draining water collected by the gutter which impinges on the outer surface of the shell.

Preferably the cap is removably attached to the rim by any suitable attachment means known in the art. Examples of suitable attachment means can be selected from a friction fit coupling, a threaded coupling, a notch and tab coupling, a hook and loop coupling, a magnetic coupling, an adhesive coupling and the like.

Advantageously, the dispensing slot may be covered by a cover pivotally mounted on the cap.

Preferably the inventive dispenser has an opening which is circular. More preferably the gutter is concentrically disposed inside the cap. Most preferably, the cap has a surface that is sloped downwardly towards the dispensing slot for gravity feeding wipes to the slot.

Advantageously, the wipes that are dispensed by the present invention have loft and are therefore compressible. Preferably, the minimum slot width is in the range of half the total thickness of the uncompressed wipe, to a maximum of four times the total thickness of the uncompressed wipe. Total thickness is defined as the overall effective thickness of the wipe in its folded or unfolded condition; for example, if a wipe were folded in half the effective wipe thickness would be twice the thickness of the unfolded wipe. Uncompressed is herein defined as the effective wipe thickness measured without any compression directed onto the wipe. More preferably, the slot width is in the range of about ½ to about 3 times the total thickness of the uncompressed wipe. Slot width is herein defined as the narrowest point in the slot where the wipe passes through that location when expelled out of the dispenser.

DETAILED DESCRIPTION

The foregoing features, advantages, and objects of this invention are now described in more detail in reference to the drawings in which like numbers represent like features.

Figure 1:
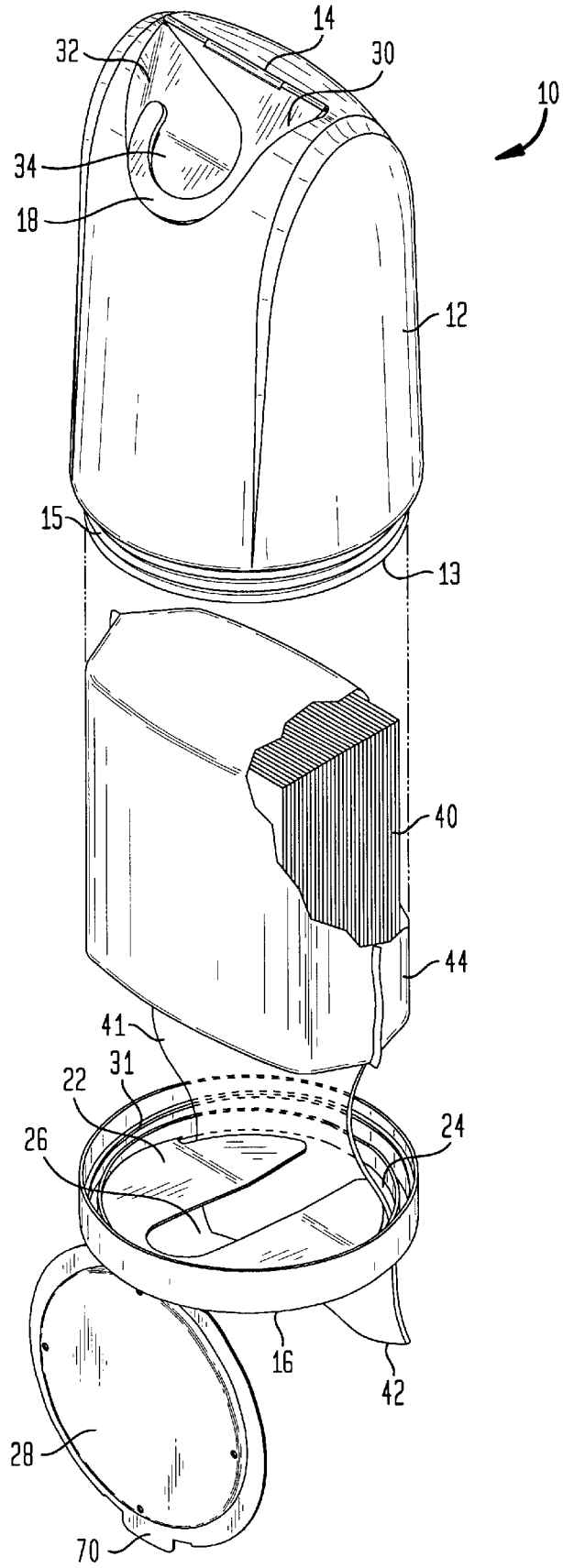
FIG. 1 is an exploded perspective view of a preferred embodiment of the wipe dispenser and wipe refill, parts being broken away for clarity.
Figure 2:
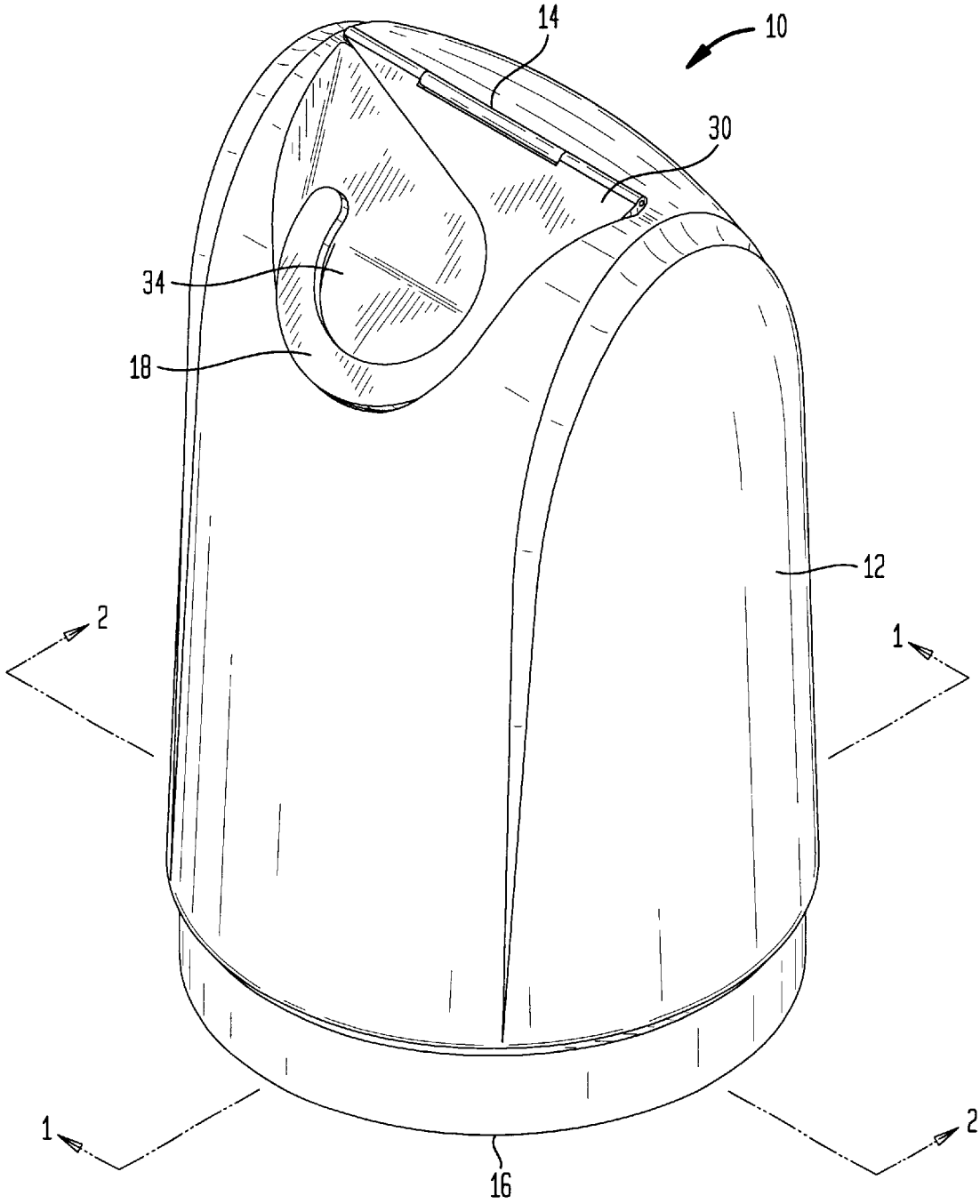
FIG. 2 is a perspective view of the wipe dispenser shown in FIGS. 1 and 1A.
Figure 2B:
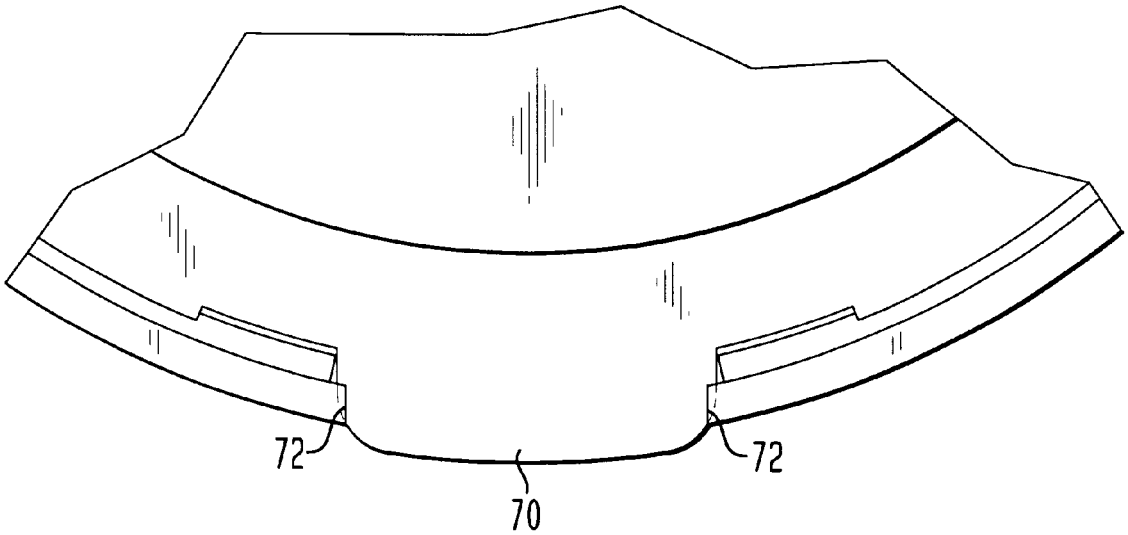
FIG. 2B is a detailed perspective view of the lid depicted in FIG. 2A engaging the end of the dispenser.
Figure 3:
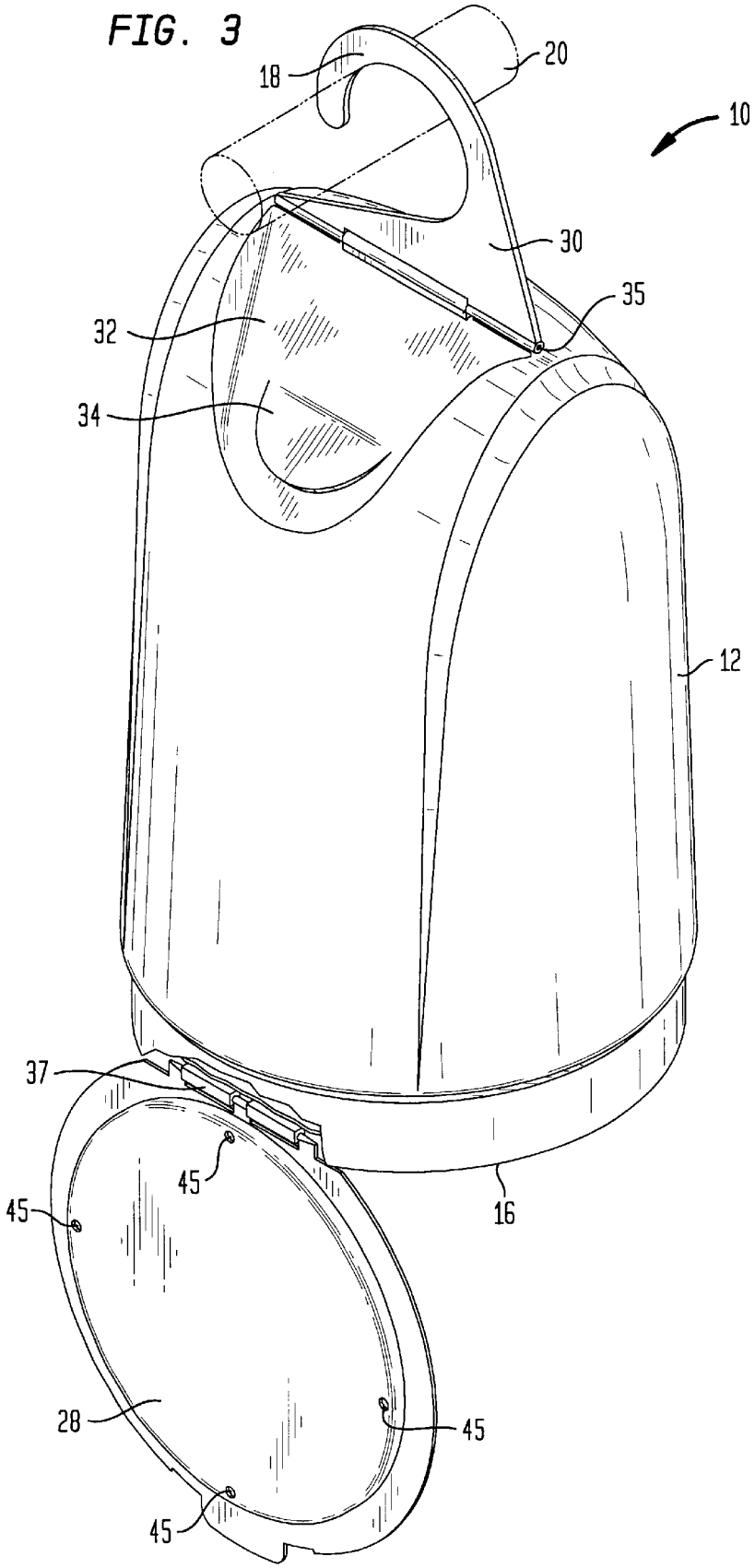
FIG. 3 is a perspective view of the wipe dispenser shown in FIGS. 1–2, showing the hook and lid in an extended position.
Figure 4A:
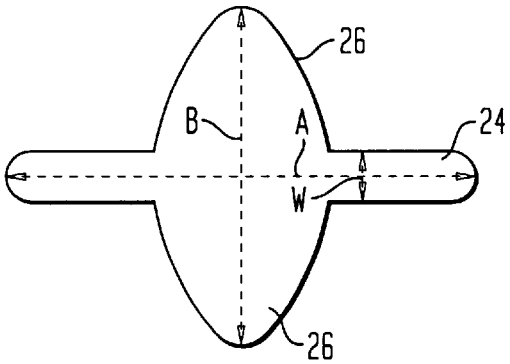
FIGS. 4A–G are bottom plan views of preferred embodiments of the dispensing slot and finger-access opening depicted in FIGS. 1 and 1A
Figure 4B:
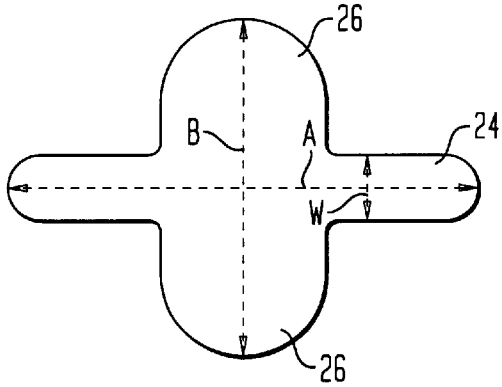
Figure 4C:
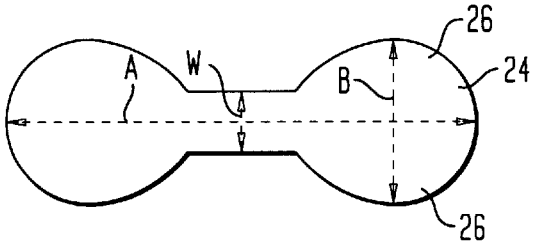
Figure 4D:
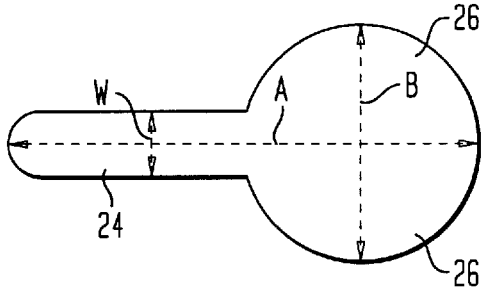
Figure 4E:
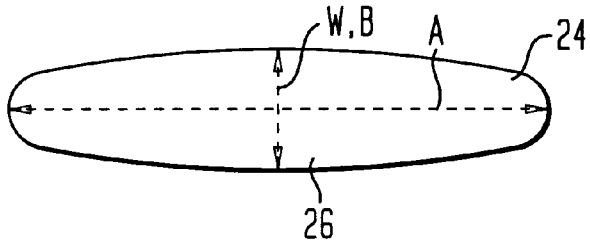
Figure 4F:
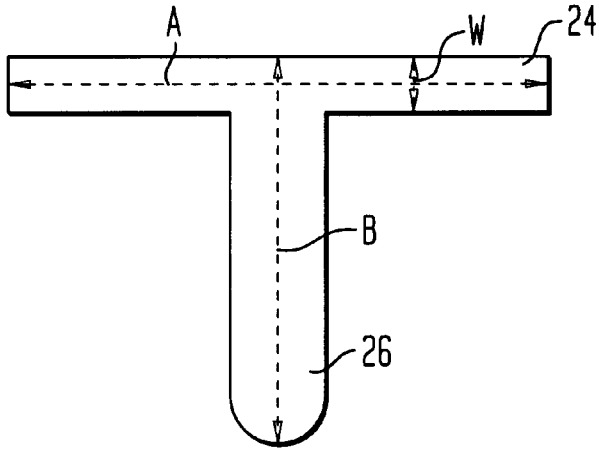
Figure 4G:
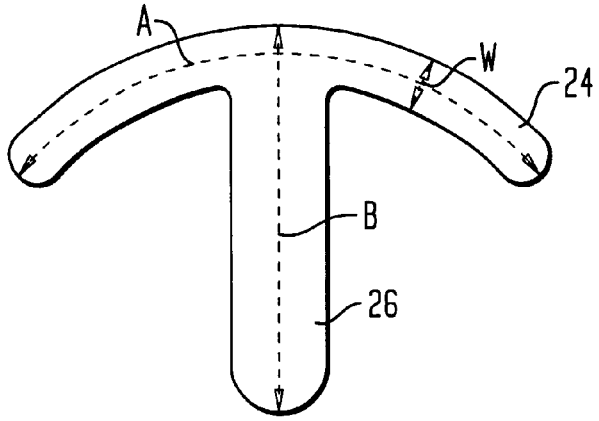

Referring now to FIGS. 1–3, a dispenser for wipes 10 includes a shell 12 having an opposed first 14 and a second end or cap 16. A support device or hook 18 is pivotally connected to the shell 12 via base 30 and hinge 35 for securing the dispenser 10 to an outside surface 20. Hook 18 is pivotally mounted on shell 12 for movement between a retracted position shown in FIGS. 1–2 and an extended position shown in FIG. 3. In its retracted position, hook 18 is positioned in recessed portion 32 on shell 12, and in pressing engagement with protuberance 34. The cap 16 defines the bottom surface 22 which has a dispensing slot 24 and a finger-access opening 26. Lid 28 is pivotally coupled to the cap 16 via hinge 37 for movement between the closed position covering the dispensing and finger access openings 24 and 26, and an open position exposing the openings. In its closed position lid 28 is secured to cap 16 when tab 70 is moved into pressing engagement with locking tabs 72, shown in greater detail in FIG. 2B. Refill dispenser kit 44 containing a plurality of wipes 40 is shown being received in shell 12 of wipe dispenser 10. Also shown, is a single wipe 41 having leading edge 42 being dispensed through dispensing slot 24. Advantageously, cap 16 having threads 31 engages shell 12 having complementary thread 15.

Figure 1A:
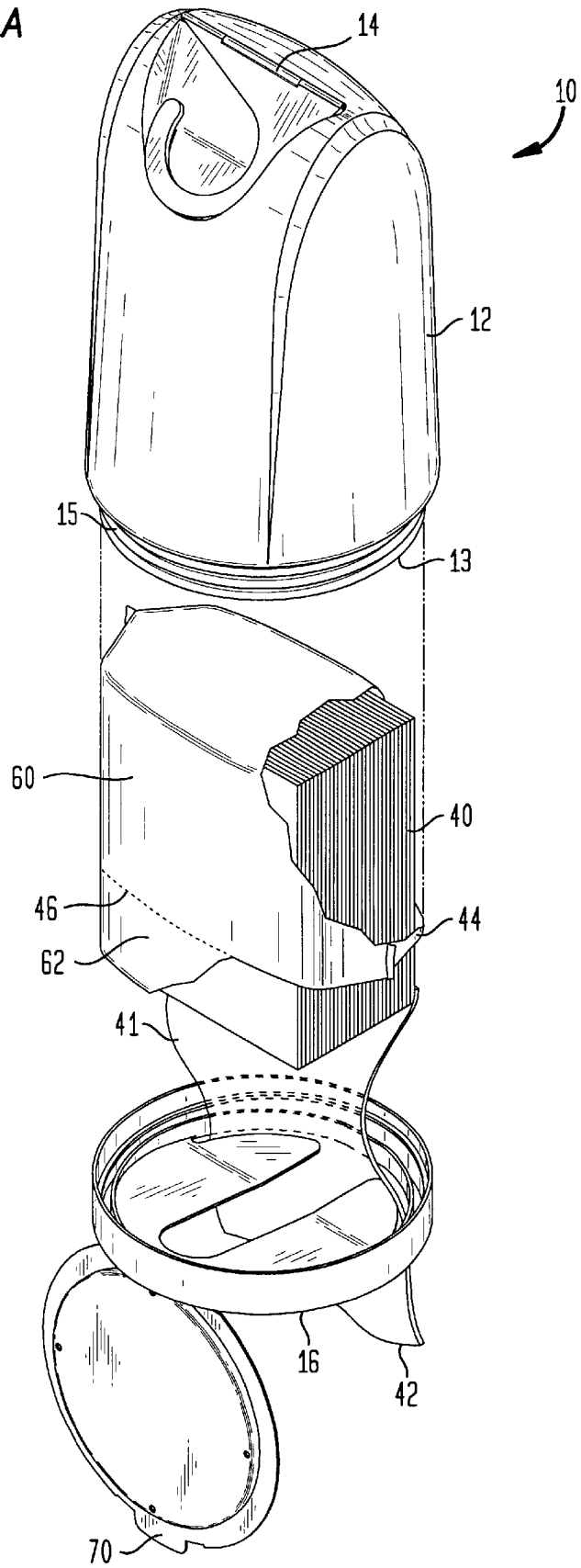
FIG. 1A is an exploded perspective view of the wipe dispenser shown in FIG. 1 with a second preferred embodiment of the wipe refill.

Now referring to FIG. 1A, another embodiment of refill kit 44 is depicted. Refill dispenser kit 44 is shown having an upper portion 60 and a base 62 wherein the upper portion is detachable along a line of weakness 46 exposing the plurality of wipes 40 and allowing wipe 41 to be dispensed.

Figure 2A:
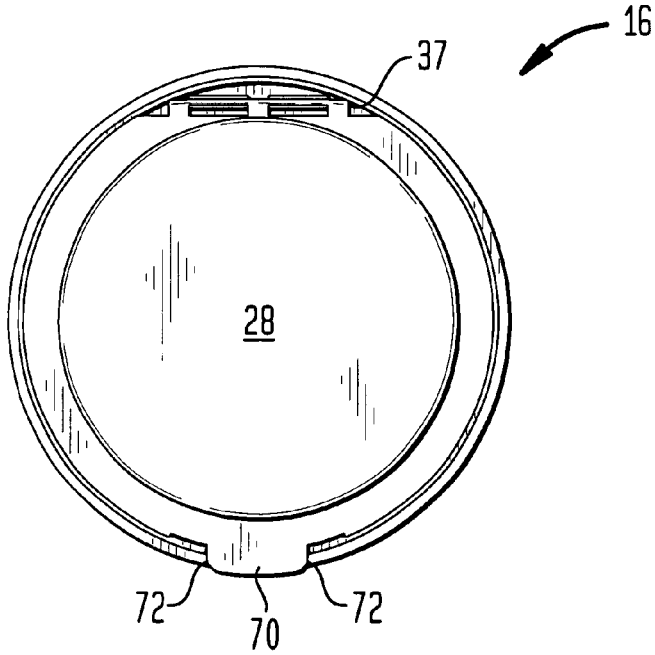
FIG. 2A is a bottom plan view of the wipe dispenser shown in FIGS. 1–3 showing the lid in the closed position.

FIG. 2 is a perspective view of wipe dispenser 10 showing hook 18 in a retracted position and lid 28 (not shown) in the closed position. FIGS. 2A and 2B show lid 28 having hinge 37 in its closed position when tab 70 engages locking tabs 72.

Now referring to FIG. 3, wipe dispenser 10 is shown with hook 18 in extended position engaging outside surface 20. Also shown is lid 28 in the open position.

Now referring to FIGS. 4A–G, the respective length dimensions of each dispensing slot in FIGS. 4A–G are illustrated by broken line A. The respective width dimensions of each dispensing slot in FIGS. 4A–G are illustrated by broken line W. The respective length dimensions of each finger-access opening in FIGS. 4A–G are illustrated by broken line B. In some instances, for example in FIG. 4E, broken line W is coincident with broken line B. FIGS. 4A–G illustrate various dispensing and finger-access opening shapes which are suitable for dispensing cleansing wipes by sequentially positioning the leading edge of the cleansing wipe via the finger access opening so that it is aligned with the dispensing slot and thus allowing a single wipe to be grasped and then pulled through the slot.

Figure 5A:
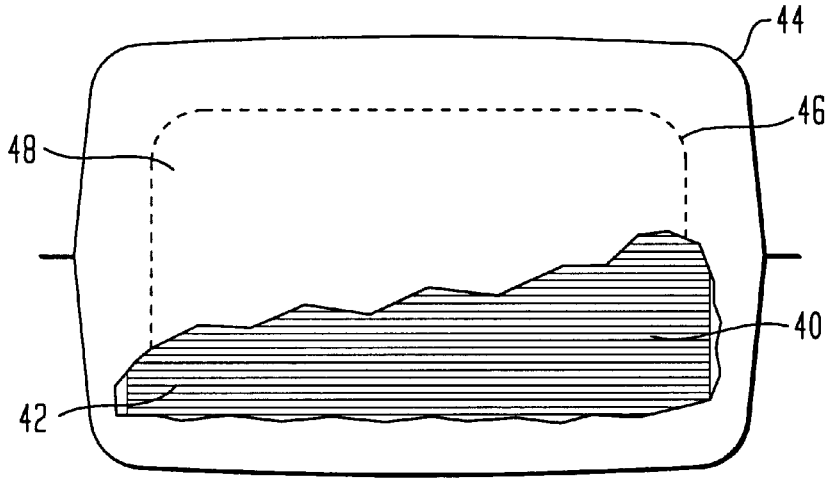
FIG. 5A is a bottom plan view of the wipe dispenser refill shown in FIG. 1, parts being broken away for clarity.

Now referring to FIG. 5A, disposable wipes refill kit 44 contains a stack of a plurality of wipes 40 which is revealed in the cut-away portion of bottom panel 48. Bottom panel 48 is detachable from wipe refill kit 44 along line of weakness 46, revealing the leading edge 42 of the plurality of the stack of wipes 40.

Figure 5B:
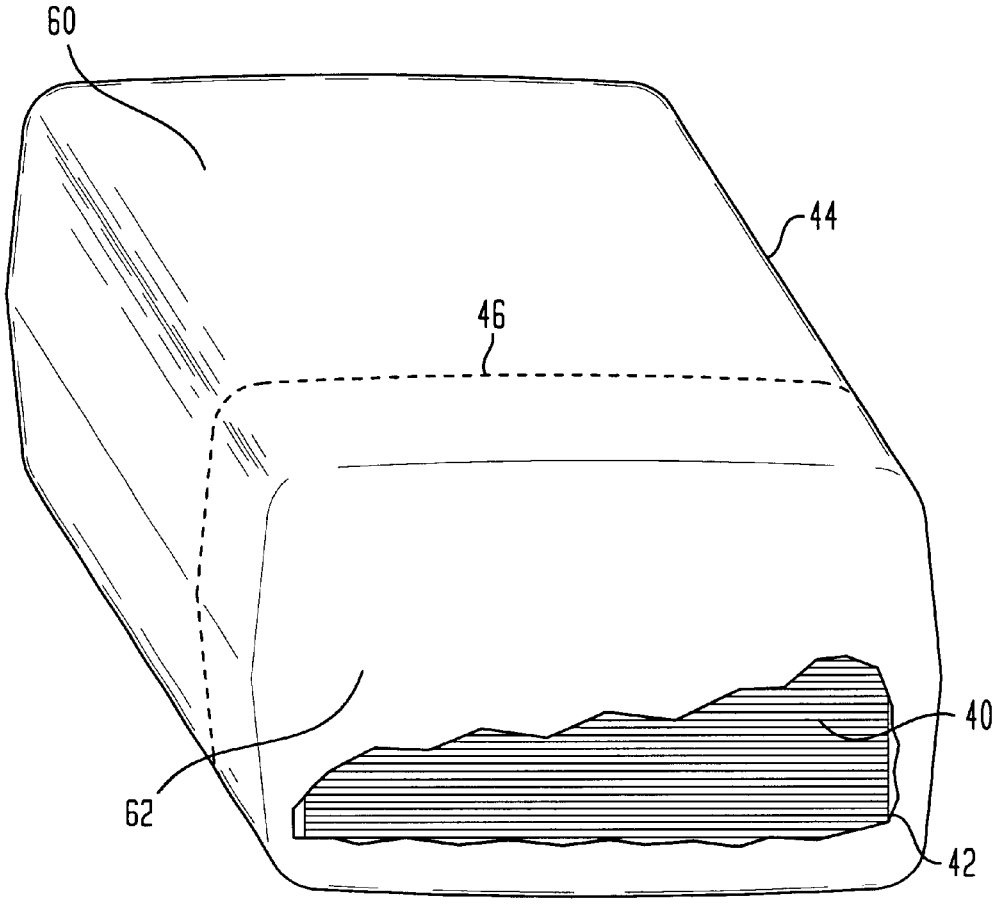
FIG. 5B is a perspective view of the wipe dispenser refill shown in FIG. 1A, parts being broken away for clarity.

Now referring to FIG. 5B, disposable wipes refill kit 44 contains a stack of a plurality of wipes 40 which is revealed when base 62 is detached from upper portion 60 along line of weakness 46 revealing the leading edge 42 of the plurality of the stack of wipes 40.

Figure 5C:
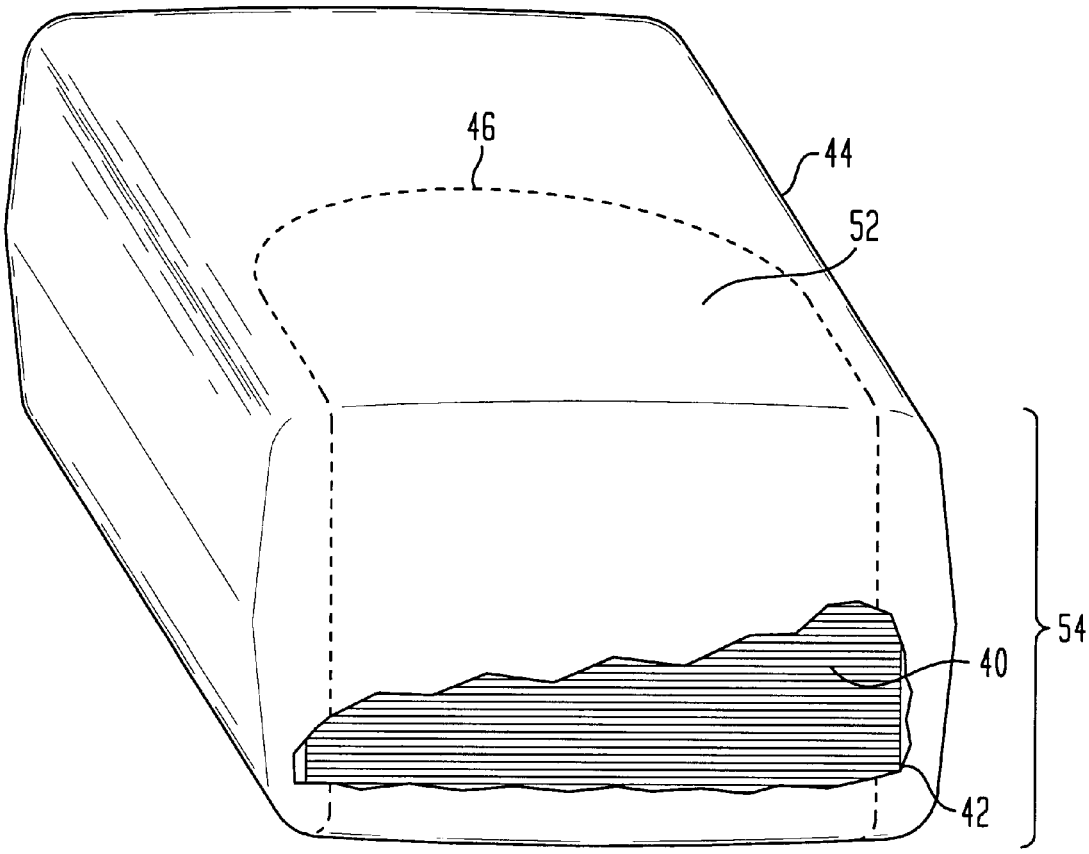
FIG. 5C is a perspective view of another preferred embodiment of a wipe dispenser refill, parts being broken away for clarity.
Figure 6A:
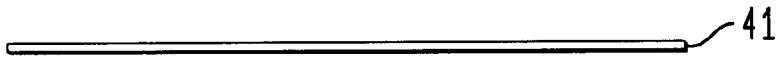
FIGS. 6A–F are side elevational views of preferred embodiments of the cleansing wipe of the invention.
Figure 6B:
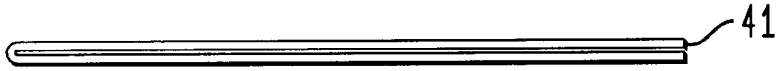
Figure 6C:
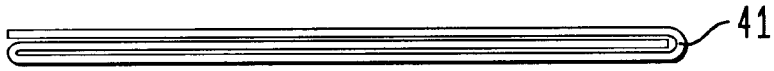
Figure 6D:
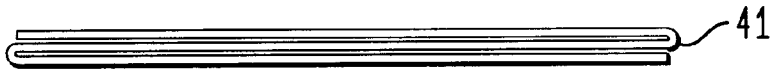
Figure 6E:
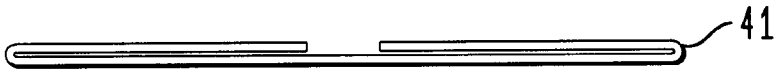
Figure 6F:
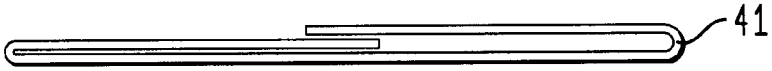
Figure 7:
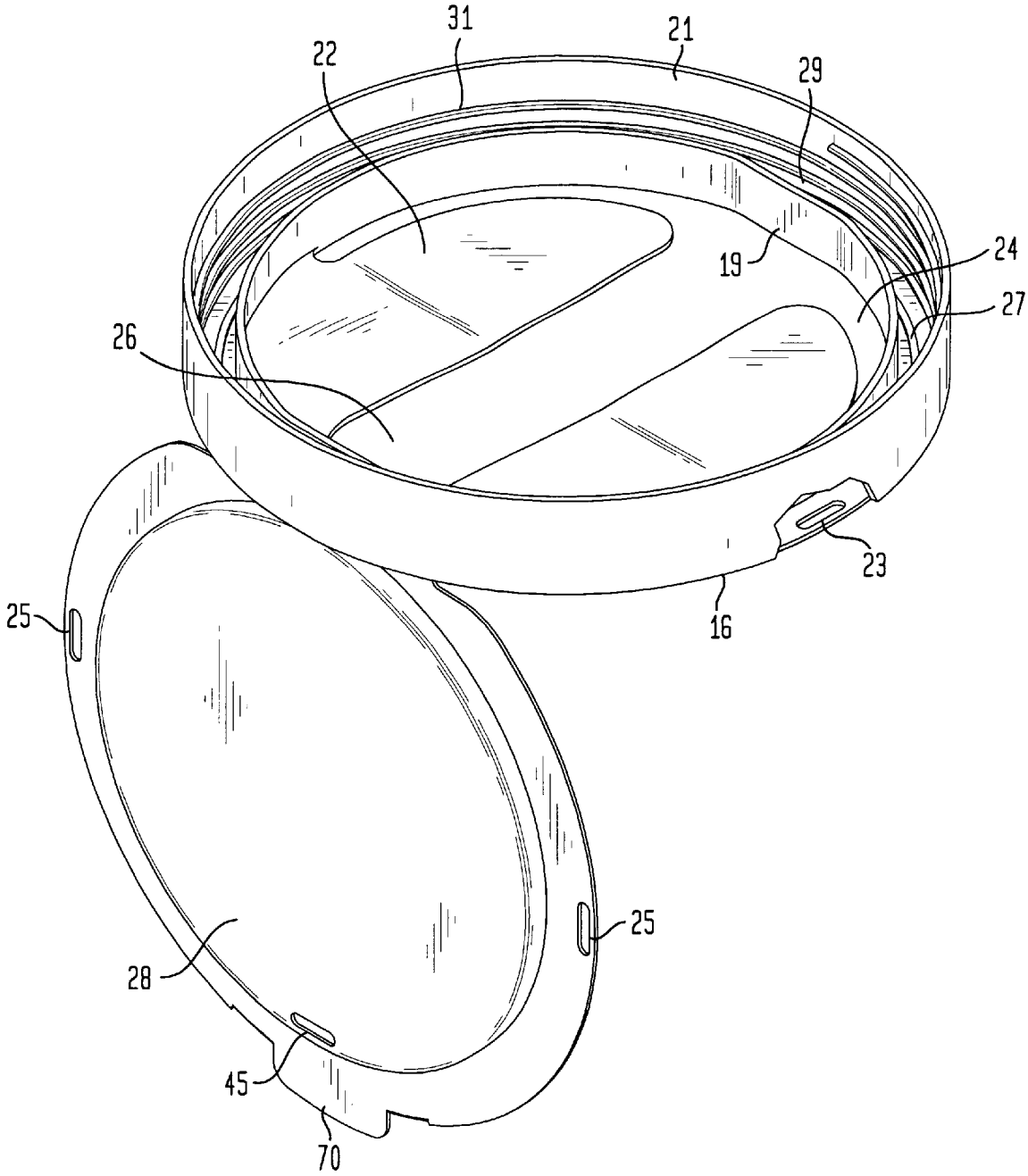
FIG. 7 is a perspective view of a preferred embodiment of the cap of the wipe dispenser shown in FIGS. 1, 1A, 2, and 3.

Now referring to FIG. 5C, disposable wipes refill kit 44 contains a stack of a plurality of wipes 40 which is revealed in the cut-away portion of end panel 54. Saddle perforation panel 52 is detachable from wipe refill kit 44 along line of weakness 46 revealing the major portion of the leading edge 42 of the plurality of the stack of wipes 40. Major portion as used herein, is defined as more than about 50% of the leading edge of the wipe, preferably more than about 70% of the leading edge of the wipe. In this context, the leading edge length dimension may be reduced by folding the wipe into bi-, z-, or overlapping-fold configurations, for example, and the like. In the case of the folded wipe the leading edge length dimension will be the length of the folded wipe.

Referring now to FIGS. 6A–F are various embodiments of wipe 41 shown in an unfolded (6A), bi-folded (6B), tri-folded (6C), z-folded (6D), c-folded (6E), and overlapping folded (6F) arrangement. Preferably, the unfolded or folded wipes are stacked and are not interfolded.

Figure 8:
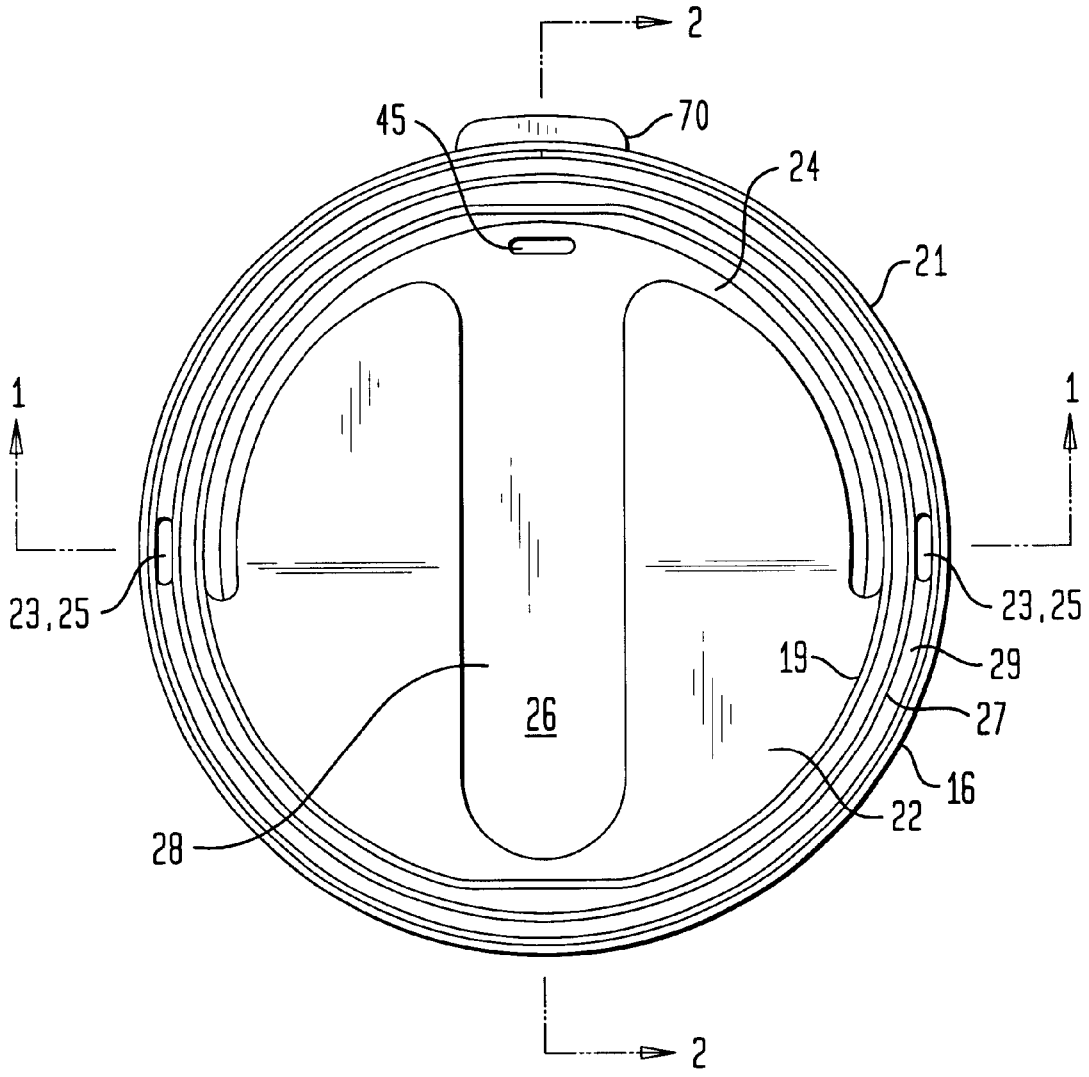
FIG. 8 is a top plan view of the cap of the wipe dispenser shown in FIG. 7, with the lid in the closed position.
Figure 8A:
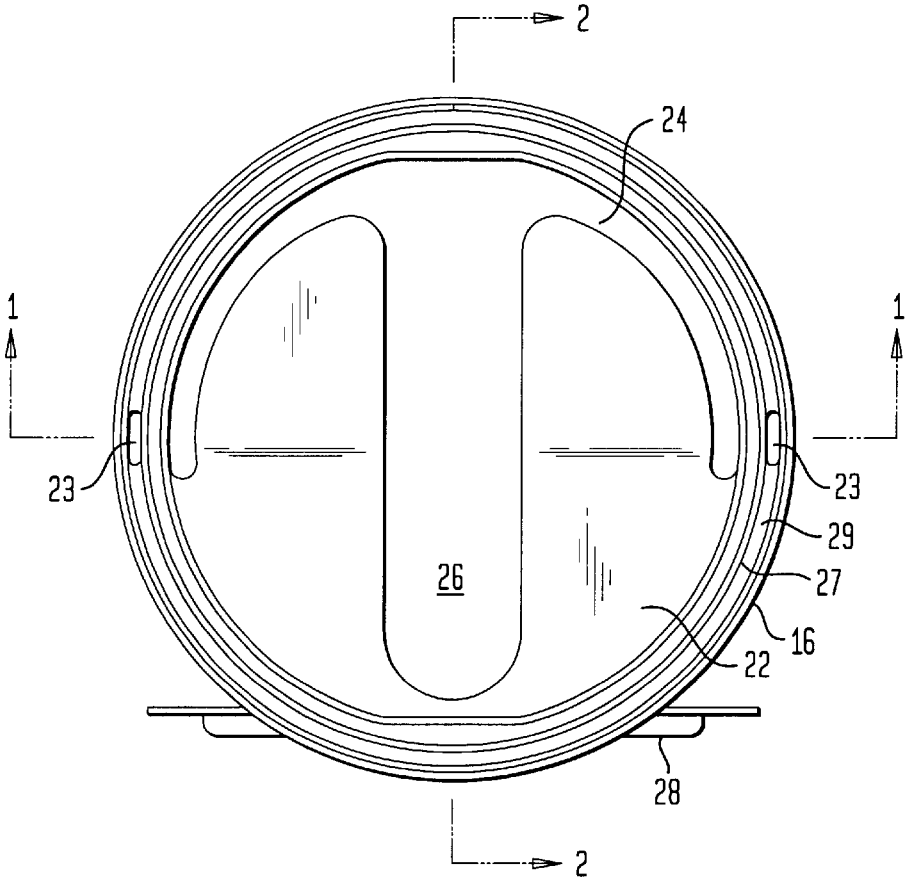
FIG. 8A is a top plan view of the cap of the wipe dispenser shown in FIG. 7, with the lid in the open position.
Figure 9:
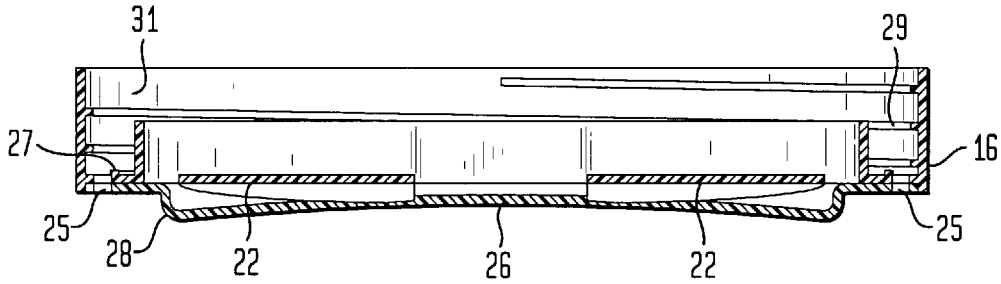
FIG. 9 is a cross-sectional view of the cap of the wipe dispenser shown in FIG. 8, taken along line 1—1.
Figure 10:
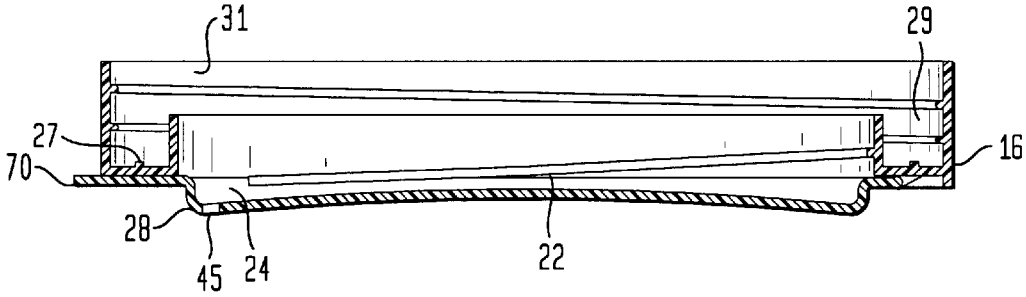
FIG. 10 is a cross-sectional view of the cap of the wipe dispenser shown in FIG. 8, taken along line 2—2.

Now referring to FIGS. 7–10, a preferred embodiment of cap 16 is depicted. The cap 16 defines the bottom surface 22 that is sloped downwardly towards the dispensing slot 24 for gravity assistance feeding the plurality of wipes 40 to the slot 24. Cap 16 also defines gutter 29 adapted for receiving rim 13 in a sealing relationship with the cap 16 when rim 13 is pressed in sealing engagement with seal 27. In the embodiment illustrated in FIG. 7, cap 16 threadably engages rim 13. Also illustrated is lid 28 pivotally coupled to the cap 16 via hinge 37 for movement between the closed position covering the dispensing and finger access openings 24 and 26 respectively as depicted in FIG. 8 and in the open position exposing the openings as depicted in FIG. 8A. Cap 28 contains drainage holes 25, which fluidly communicate, with drainage holes 23 in cap 16. Cap 28 also contains drainage hole 45 which fluidly communicates with dispensing slot 24. In operation, shower water spray will impinge on shell surface 12, run past threads 31 into gutter 29 and flow out of the dispenser via holes 23 and 25, without contacting the plurality of wipes contained within the dispenser. Shower water spray which penetrates inside shell 10 will contact lid 28 and be directed towards drainage hole 45. Preferably lid 28 has a convex profile which facilitates the flow of water from the center towards the edge of the lid 28 and to drainage hole 45.

Figure 11:
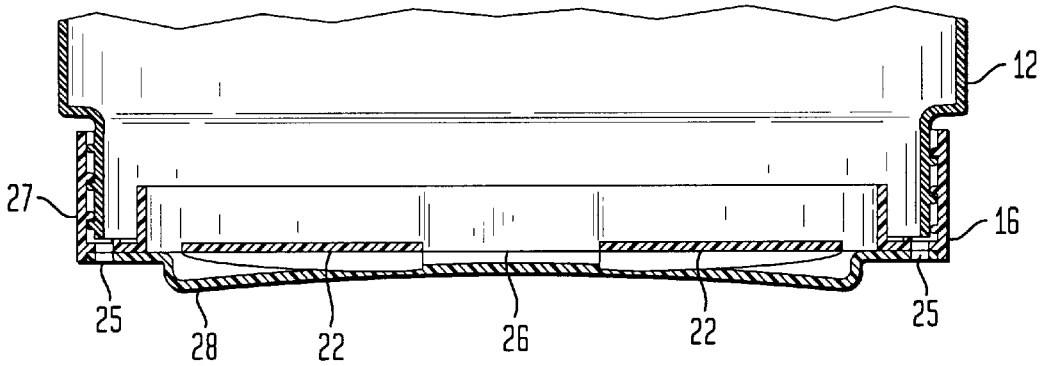
FIG. 11 is a partial cross-sectional view of a preferred embodiment of the cap shown in FIG. 2 in sealing engagement with the wipe dispenser shell taken along line 1—1.
Figure 11A:
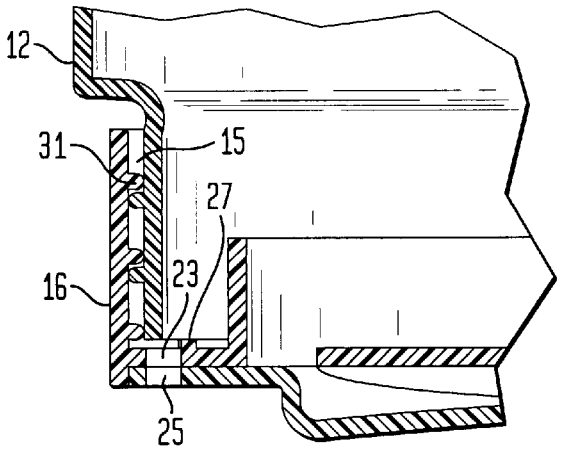
FIG. 11A is an enlarged partial cross-sectional view of the embodiment of FIG. 11.
Figure 12:
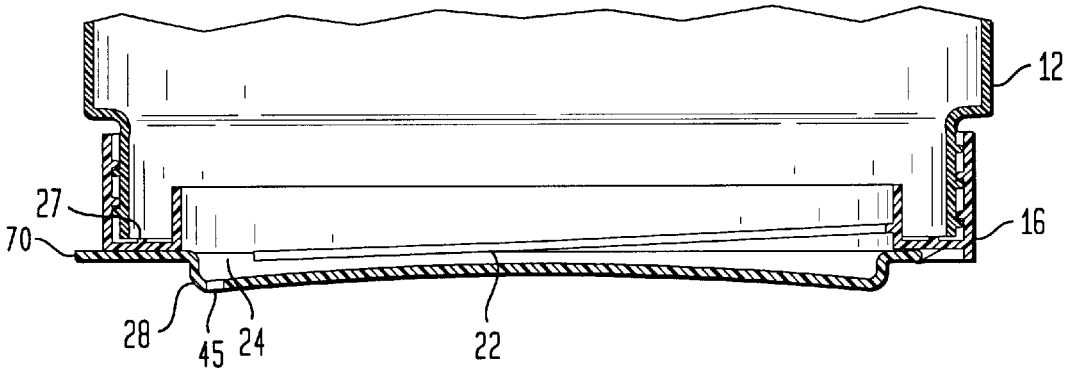
FIG. 12 is a partial cross-sectional view of a preferred embodiment of the cap shown in FIG. 2 in sealing engagement with the wipe dispenser shell taken along line 2—2.

Now referring to FIGS. 11, 11A and 12, cap 16 is shown in sealing relationship with shell 12 via interlocking threads 16 and 15 whereby rim 13 is brought into sealing contact with sealing surface 27.

Advantageously, the ratio of the slot width to the effective thickness of the uncompressed wipe is in the range of about 1:2 to about 4:1, preferably from about 1:2 to about 3:1. Slot width is here defined as the narrowest portion of the slot through which the wipe passes. The wipe may be either in the folded or unfolded state. The effective thickness of the uncompressed wipe can be the thickness of the wipe or a multiple of the thickness of the wipe depending on the degree of folding of the wipe. Useful wipes that can be dispensed with the inventive dispenser possess a certain degree of loft such that they can be compressed before being pulled through the dispensing slot.

While this invention has been described with respect to a particular embodiments thereof, it is apparent that numerous other forms and modifications of the invention will be obvious to those skilled in the art. Independent claims in this invention generally should be construed to cover all such obvious forms and modifications which are within the true spirit and scope of the present invention.

What is claimed is:

1. A dispenser for wipes comprising:

a) a shell having opposed first and second ends;

b) a support device connected to the shell for securing the dispenser to an outside surface; and c) the second end defined by a bottom surface having a dispensing slot with a length dimension greater than a width dimension, and a finger-access opening located at an effective distance from the dispensing slot for urging at least one of the wipes in the direction of the dispensing slot.

2. The dispenser of claim 1 further comprising a lid coupled to the second end for movement between a closed position covering the dispensing slot and an open position exposing the dispensing slot.

3. The dispenser of claim 2 wherein the lid has at least one drain opening to prevent accumulated water from contacting the wipes when the lid is moved to the closed position.

4. The dispenser of claim 1 wherein the second end is removably attached to the shell.

5. The dispenser of claim 4 wherein the second end is sloped towards the dispensing slot for gravity feeding the wipes to the slot.

6. The dispenser of claim 1 wherein the support device is selected from mechanical couplers, suction couplers, adhesive, and magnetic couplers.

7. The dispenser of claim 6 wherein the support device is a hook having a base, the base being pivotally coupled to the shell for movement between a retracted storage position and an extended position for engaging an outer surface.

8. The dispenser of claim 7 wherein the shell further includes a recessed portion and a protuberance rigidly connected to the shell, the hook in its retracted storage position being arranged in the recessed portion of the shell and in pressing engagement with the protuberance.

9. The dispenser of claim 1 wherein the finger access opening intersects with the dispensing slot.

10. The dispenser of claim 1 wherein the shell is closed at the first end.

11. A dispenser system for dispensing disposable wipes, comprising:

a) a shell having opposed first and second ends;

b) a support device connected to the shell for securing the shell to an outside surface;

c) the second end defined by a bottom surface having a dispensing slot with a length dimension greater than a width dimension, and a finger access opening located at an effective distance from the dispensing slot for urging at least one of the wipes in the direction of the dispensing slot; and d) a plurality of individual disposable wipes, each having a leading edge, positioned within the shell, and stacked with the leading edge of each of the plurality of wipes supported by the bottom surface.

12. The dispenser system of claim 11 wherein the bottom surface is openable and the plurality of wipes is situated inside a refill dispenser positioned within the shell.

13. The dispenser system of claim 12 further comprising a lid pivotally coupled to the openable bottom surface for movement between a closed position and an open position for dispensing wipes.

14. The dispenser system of claim 11 wherein the refill dispenser is a thermoplastic, flexible pouch having a line of weakness.

15. The dispenser system of claim 11 wherein the disposable wipes are substantially dry and contain at least one lathering surfactant.

16. The dispenser system of claim 15 wherein at least one lathering surfactant is an anionic surfactant.

17. The dispenser system of claim 15 wherein the anionic surfactant is present in the concentration range of about 20 to about 80 wt. % based on the wipe.

18. The dispenser system of claim 15 wherein the ratio of the slot width to the effective thickness of the uncompressed wipe is in the range of about 1:2 to about 4:1.

19. The dispenser system of claim 15 wherein the wipes are separately folded and are not interfolded with adjacent wipes.

20. A dispenser for containing wiping articles usable in a shower environment, comprising:

a) a shell having opposed top and bottom ends, an outer surface connecting the top and bottom ends, and an opening defined by a rim at the bottom end through which wiping articles may be dispensed;

b) a cap fittable over the rim; and c) a gutter adjacent to the cap for collecting water impinging on the outer surface and directing the water away from the articles contained within the shell.

21. The dispenser of claim 20 further comprising a surface adjacent to the gutter arranged for sealingly contacting the rim when the cap is fitted over the rim.

22. The dispenser of claim 21 wherein the surface is disposed within the gutter and the gutter is formed within the cap.

23. The dispenser of claim 20 wherein the cap defines a dispensing slot having a length dimension greater than a width dimension and a finger access opening located at an effective distance from the dispensing opening for urging at least one of the wiping articles in the direction of the dispensing opening.

24. The dispenser of claim 23 further comprising a cover pivotally mounted on the cap, the cover having an interior surface and defining at least one drainage hole in fluid communication with the shell when the cover is in a closed position.

25. The dispenser of claim 24 wherein the interior lid surface is concave.

26. The dispenser of claim 20 wherein the gutter defines at least one drainage hole for draining water collected by the gutter.

27. The dispenser of claim 20 wherein the cap is removably attached to the rim by attachment means selected from a friction fit coupling, a threaded coupling, a notch and tab coupling, a hook and loop coupling, a magnetic coupling, and an adhesive coupling.

28. The dispenser of claim 20 wherein the opening is circular.

29. The dispenser of claim 20 wherein the gutter is concentrically disposed inside the cap.

30. The dispenser of claim 20 wherein the cap has a surface that is sloped towards the dispensing slot for gravity feeding wiping articles to the slot.

31. The dispenser of claim 20 further comprising a support device connected to the shell for securing the dispenser to an outer surface.

* * * * *